US005381976A

United States Patent [19]

Chon et al.

[11] Patent Number: 5,381,976

[45] Date of Patent: Jan. 17, 1995

[54] REPLACEABLE TIP HAMMER

[75] Inventors: David N. Chon, Baltimore, Md.; Andrew V. Maynard, West Palm Beach, Fla.

[73] Assignee: The Babcock & Wilcox Company, New Orleans, La.

[21] Appl. No.: 223,360

[22] Filed: Apr. 5, 1994

Related U.S. Application Data

[63] Continuation-in-part of Ser. No. 74,509, Jun. 11, 1993, abandoned.

[51] Int. Cl.[6] ..... B02C 13/28

[52] U.S. Cl. ..... 241/197; 241/300

[58] Field of Search ..... 241/194, 197, 300

[56] References Cited

U.S. PATENT DOCUMENTS

| | | | |
|---|---|---|---|
| 2,318,219 | 5/1943 | Harris | 241/197 |
| 2,534,301 | 12/1950 | Sennholtz | 241/197 |
| 4,000,859 | 1/1977 | Whitney | 241/194 |
| 4,117,985 | 10/1978 | Lazareck | 241/197 |

*Primary Examiner*—John Husar

*Attorney, Agent, or Firm*—Robert J. Edwards

[57] ABSTRACT

A hammer for use in shredders and comprising a hammer holder with a dovetail key and a hammer tip having a dovetail groove shaped to receive the dovetail key. The hammer tip is slidably engageable with the hammer holder by sliding the dovetail groove over the dovetail key. Centrifugal force from the hammer rotation keeps the tip secured to the holder. The hammer tip is also wider than the hammer holder in order to protect the holder from wear and tear.

2 Claims, 2 Drawing Sheets

REPLACEABLE TIP HAMMER

FIELD AND BACKGROUND OF THE INVENTION

This application is a continuation in part of Ser. No. 08/074,509, filed Jun. 11, 1993, now abandoned.

The present invention relates, in general, to the replacement of hammers used in shredders and, more particularly, to a new and useful hammer having a replaceable tip.

Shredders are used in a variety of industrial applications. Typically, a shredder consists of an enclosed rotor with hammers attached to the rotor by means of hammer pins. The rotor is spun at a high rate of speed by either an electric motor or diesel engine drive. Material is fed into the enclosed shredder and is impacted by the heavy high speed hammers thereby reducing the particle size of the feed material. Through continued use of the shredder equipment, the hammers will wear out and require replacement. A common method of replacing a hammer requires the removal of the hammer pins.

Replaceable tip hammers have become popular since only the hammer tip, rather than the entire hammer, requires removal and replacement.

Some of the prior art replaceable hammer tips employ either a pin or bolt and a tip holder. U.S. Pat. No. 4,117,985 discloses one such replaceable tip hammer for use in shredders with the replaceble tip being bolted to the hammer.

However, problems have been encountered with the prior art replaceable hammer tips such as the breaking of the bolts or the tips themselves which cause damage to the shredder and excessive wear on the hammer tip holders.

SUMMARY OF THE INVENTION

The present invention concerns a replaceable hammer tip for use in shredders and comprises a hammer having a hammer holder with a dovetail key and a hammer tip having a dovetail groove shaped to receive the dovetail key. Centrifugal force from the hammer rotation keeps the tip secured to the holder. The hammer tip is slightly wider than the holder, thus protecting the holder from wear and tear.

The present invention provides for a replaceable hammer tip that eliminates the use of a bolt or pin to hold the hammer tip in place.

The various features of novelty which characterize the invention are pointed out with particularity in the claims annexed to and forming a part of this disclosure. For a better understanding of the invention, its operating advantages and the specific objects attained by its uses, reference is made to the accompanying drawings and descriptive matter in which the preferred embodiments of the invention are illustrated.

DESCRIPTION OF THE PREFERRED EMBODIMENTS

Figure 1:
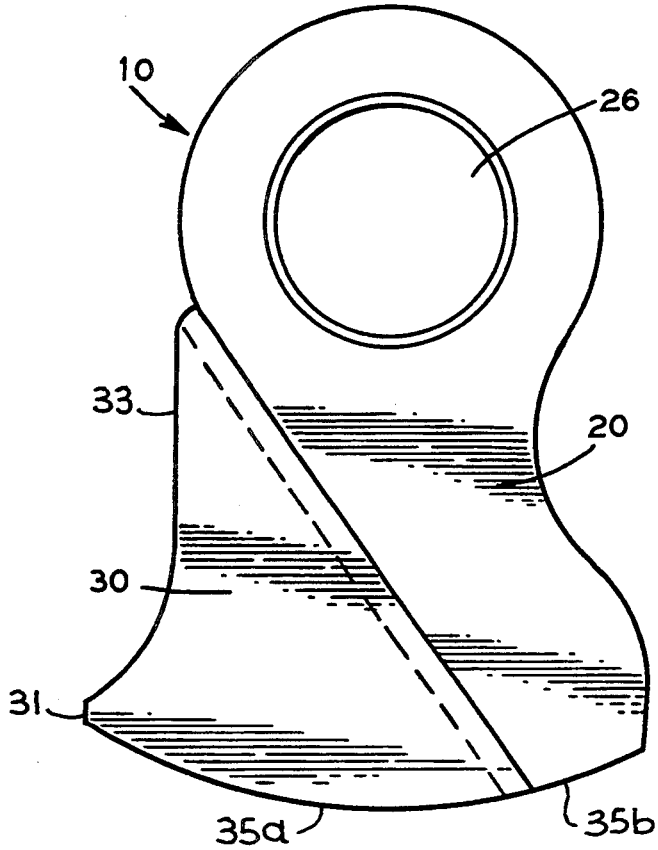
FIG. 1 is a side elevation view embodying the present invention.

Referring to the drawings and, in particular, the invention embodied in FIG. 1 there is shown a hammer, generally designated 10, having a hammer holder 20 slidably engageable with a hammer tip 30. The hammer 10 is secured for rotation to a shredder, not shown, by means of a shaft, not shown, extending through an opening 26 in the hammer holder 20.

Figure 3:
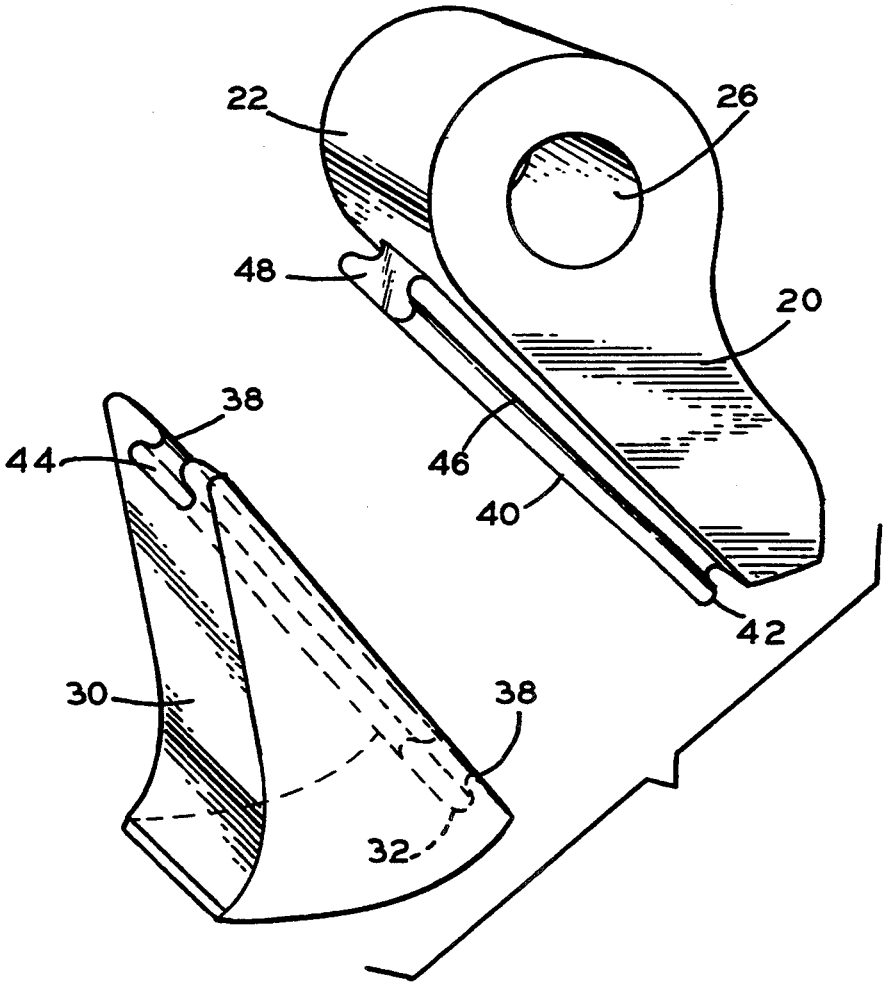
FIG. 3 is a perspective view embodying the present invention.

As shown in FIG. 3, the holder 20 has a dovetail key 40 mounted to a surface 22. The key 40 has a remote end 48 and an opposite mating end 42. The key 40 includes outer edges 46 which extend from the remote end 48 to the mating end 42. The remote end 48 is tapered and the outer edges 46 extend and diverge to the mating end 42 such that the mating end 42 has a greater width than the remote end 48. The key 40 is designed so that the remote end 48 has a greater depth than the mating end 42.

Tip 30 includes a dovetail groove 44 that is shaped to receive the dovetail key 40 of the holder 20. The tip 30 is slidably engageable with the holder 20 enabling the dovetail groove 44 to receive the dovetail key 40 of the holder 20. The groove 44 receives the key 40 such that the key mating end 42 is aligned with a groove mating end 32 of the tip 30 and the key remote end 48 is aligned with a groove remote end 38 of the tip 30. The dovetail groove 44 is arranged on an inner surface 34 of the tip 30 such that it aligns with the inner surface 22 of the holder 20. Centrifugal force keeps the tip 30 secured to the holder 20 and is locked in position through the interlocking of the dovetail key 40 within the dovetail groove 44.

Figure 2:
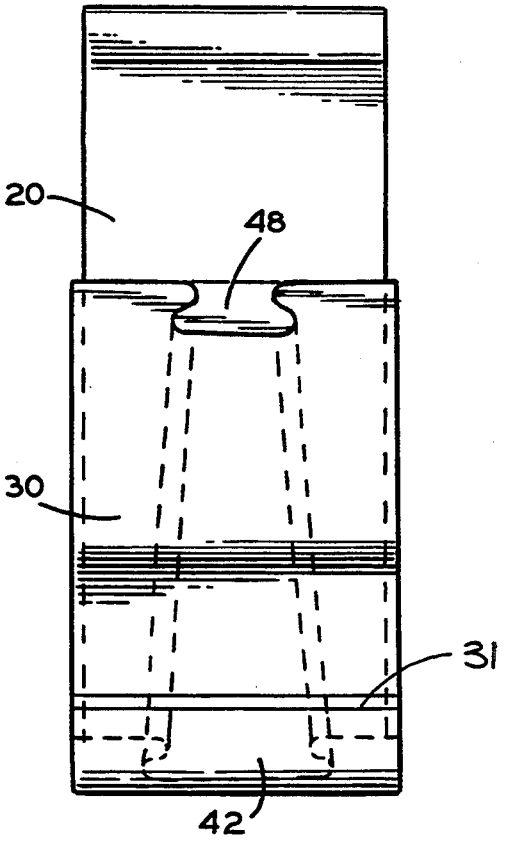
FIG. 2 is a front elevation view embodying the present invention.

In FIG. 2, the tip 30 is shown with greater width than the holder 20 in order to protect the holder 20 from excessive wear and tear thereby minimizing the frequency of replacement of the holder 20. As shown in FIGS. 2 and 3, the tip 30 has a flat protruding surface 31, extending across the outer surface of tip 30 and extending across the entire width of tip 30. The protruding surface 31 is an important feature of the hammer 10 in that it promotes more of a cutting action than a beating action. As shown in FIG. 1, the surface 31 is between a concave curved outer surface 33 extending roughly radially of opening 26, and a convex curved circumferential surface **35*a* of tip 30, which is contiguous with a convex curved circumferential surface 35*b* on holder 20**.

With respect to standard hammers, the present invention advantageously minimizes the equipment downtime necessary for the replacement of hammer tips, reduces the labor cost associated with the replacement of hammer tips and allows an operator the option of changing hammer tips for only those hammers that are severely worn, thereby prolonging the life of partially worn hammers that are not yet in need of changing.

It is generally common practice, when using the standard method of removing hammer pins for the changing of hammers, to change all of the hammers at the same time. The high labor cost and extended equipment downtime needed for the changing of hammers using this practice does not justify changing only some of the hammers. However, with the present invention, it is possible to maximize the life of a hammer with minimum labor cost and equipment downtime by replacing only fully worn hammer tips.

In contrast to the known replaceable tip hammers, the present invention does not utilize a bolt or pin to secure the hammer tip to the holder thereby eliminating the risk of bolt breakage and the possibility for damage to the shredder as a result of the hammer tip becoming detached from the holder. Furthermore, the elimination of the need for a bolt or pin reduces the equipment downtime needed to replace a hammer tip.

The overlap provided in the replacement tip of the present invention protects the holder from excessive wear thereby minimizing the frequency of hammer tip holder replacements. In addition, the present invention provides for a greater surface area contact between the replaceable hammer tip and the hammer tip holder thereby reducing the risk of hammer tip breakage by distributing the forces of impact over a greater surface area.

While the specific embodiments of the invention have been shown and described in detail to illustrate the application of the principles of the invention, it will be understood that the invention may be embodied otherwise without departing from such principles.

What is claimed is:

1. A hammer for use in a shredder, the hammer comprising:

a holder;

a dovetail key having a mating end and a remote end arranged on an inner surface of the holder, the key having outer edges which extend and diverge from the remote end to the mating end, the key having a depth that decreases from the remote end to the mating end;

a replaceable tip having a concave curved outer surface, a convex curved circumferential surface and an inner surface, the tip including a flat protruding surface between the outer surface and the circumferential surface, the outer surface having a protruding edge being subject to impact, the tip having a width greater than the width of the holder, the protruding surface extending across the entire width of the outer surface of the tip, the tip having a dovetail groove at the inner surface, the groove shaped to receive the dovetail key, the groove having a mating end and a remote end, the groove having a depth that decreases from the remote end to the mating end, the tip being slidably engageable with the holder such that when the groove is slid over the key the mating end of the key aligns with the mating end of the groove and the remote end of the key aligns with the remote end of the groove thereby allowing the inner surface of the holder to interlock with the inner surface of the tip, the holder including a mounting opening spaced from the dovetail key, the holder having a convex curved circumferential surface which is contiguous with the convex curved circumferential surface of the tip when the tip is mounted to the holder, the circumferential surfaces extending circumferentially with respect to the opening in the holder, the outer surface of the tip extending radially with respect to the opening; and means for mounting the hammer to the shredder.

2. The hammer according to claim 1, wherein the means for mounting the hammer to the shredder includes a shaft, the hammer being rotatably connected to said shaft.

* * * * *